US006426374B1

(12) United States Patent
Skoglund

(10) Patent No.: US 6,426,374 B1
(45) Date of Patent: Jul. 30, 2002

(54) FOUNDRY BINDER COMPOSITIONS AND MIXES THAT CONTAIN A DIVALENT SULFUR COMPOUND

(75) Inventor: Michael J. Skoglund, Dublin, OH (US)

(73) Assignee: Ashland Inc., Covington, KY (US)

( * ) Notice: Subject to any disclaimer, the term of this patent is extended or adjusted under 35 U.S.C. 154(b) by 53 days.

(21) Appl. No.: 09/627,993

(22) Filed: Jul. 28, 2000

(51) Int. Cl.[7] ..... B22C 1/22
(52) U.S. Cl. ..... 523/145; 523/144; 523/143
(58) Field of Search ..... 523/139, 142, 523/143, 145, 146

(56) References Cited

U.S. PATENT DOCUMENTS

| | | | | |
|---|---|---|---|---|
| 4,354,869 A | * | 10/1982 | Hummer et al. | 75/63 |
| 4,644,022 A | | 2/1987 | Iyer | 523/144 |
| 5,915,450 A | * | 6/1999 | Aufderheide et al. | 164/53 |

FOREIGN PATENT DOCUMENTS

| | | |
|---|---|---|
| JP | 5237587 | 9/1993 |
| SU | 131674 | 6/1987 |
| SU | 1547936 | 3/1990 |

* cited by examiner

*Primary Examiner*—Edward J. Cain
*Assistant Examiner*—Katarzyna W. Lee
(74) *Attorney, Agent, or Firm*—David L. Hedden

(57) ABSTRACT

This invention relates to foundry binder compositions that contain a divalent sulfur compound, and/or foundry mixes where the aggregate contains a divalent sulfur compound. The foundry binders and foundry mixes are used to make foundry shapes, e.g. molds and cores. The presence of sulfur in the foundry shape facilitates the removal of foundry shapes (particularly internal cores) from the metal casting which is made by pouring molten metal into a casting assembly in which the foundry shapes are arranged. The invention also relates to a method of preparing foundry shapes, the shapes prepared, a method of making a metal casting, and metal castings by this process.

26 Claims, No Drawings

FOUNDRY BINDER COMPOSITIONS AND MIXES THAT CONTAIN A DIVALENT SULFUR COMPOUND

FIELD OF THE INVENTION

This invention relates to foundry binder compositions that contain a divalent sulfur compound, and/or foundry mixes where the aggregate contains a divalent sulfur compound. The foundry binders and foundry mixes are used to make foundry shapes, e.g. molds and cores. The presence of sulfur in the foundry shape facilitates the removal of foundry shapes (particularly internal cores) from the metal casting which is made by pouring molten metal into a casting assembly in which the foundry shapes are arranged. The invention also relates to a method of preparing foundry shapes, the shapes prepared, a method of making a metal casting, and metal castings by this process.

BACKGROUND OF THE INVENTION

In the foundry industry, one of the procedures used for making metal parts is "sand casting". In sand casting, disposable molds and cores are fabricated with a mixture of sand and an organic or inorganic binder. The foundry shapes are arranged in casting assembly, which results in a cavity through which molten metal will be poured. After the molten metal is poured into the assembly of molds and cores and cools, the metal part formed by the process is removed from the assembly. The binder is needed so the molds and cores will not disintegrate when they come into contact with the molten metal.

Two of the prominent fabrication processes used in sand casting are the no-bake and the cold-box processes. In the no-bake process, a liquid curing catalyst is mixed with an aggregate and binder to form a foundry mix before shaping the mixture in a pattern. The foundry mix is shaped by putting it into a pattern and allowing it to cure until it is self-supporting and can be handled. In the cold-box process, a gaseous curing catalyst is passed through a shaped mixture (usually in a corebox) of the aggregate and binder to cure the mixture.

A binder commonly used in the cold-box fabrication process is a phenolic urethane binder. The phenolic urethane binder is mixed with an aggregate to form a foundry mix. The foundry mix is blown into pattern, typically a corebox, where it is cured by passing a gaseous tertiary amine catalyst through it. The phenolic urethane binder consists of a phenolic resin component and polyisocyanate component. Phenolic urethane binders are widely used in the foundry industry to bond the sand cores used in casting iron and aluminum. An example of a commonly used phenolic-urethane binder used in the cold-box process is disclosed in U.S. Pat. No. 3,409,575.

One of the problems with the using organic binders to form foundry shapes is that they can be too effective in binding the aggregate together. The result is that the foundry shapes are not readily separated from the metal part formed during the casting process. Consequently, time consuming and labor intensive means must be utilized to break down the binder so the metal part can be removed from the casting assembly. This is particularly a problem with internal cores, which are imbedded in the casting assembly and not easily removed.

The phenolic urethane cold-box process can be used to make cores and molds for the casting of ferrous and non-ferrous metal parts. Since iron castings are manufactured at about 1500° C., any phenolic urethane binder used in making foundry shapes, i.e. internal cores, will undergo rapid thermal decomposition at this temperature. Because of this, the internal core can be easily separated from the iron casting. This does not occur when aluminum parts are cast because aluminum castings are manufactured at about 700° C. At this lower temperature, the phenolic urethane binder does not readily decompose when the aluminum is cast, thus making complete removal of an internal core difficult.

Since light alloy casting, such as aluminum casting, is becoming increasingly used in place of iron as a means of reducing the weight of vehicle components such as engine blocks and manifolds, there is a need for developing new methods which facilitate the removal of internal cores. One method of facilitating removal of an internal core from a large aluminum casting (e.g. an engine block) or a complex aluminum casting (e.g. a water pump housing), is by baking the casting in a forced air oven at a high temperature for five to ten hours until the binder slowly decomposes. This procedure reduces productivity and requires forced air ovens and large amounts of energy. Alternatively, some aluminum castings can be violently shaken until the internal core is released. This procedure is inefficient and also reduces productivity.

Alternatives to phenolic-urethane cold-box binder systems can be used for aluminum casting that afford good core removal. For example, furan cold-box resins display excellent core removal characteristics in aluminum casting. However, furan resin binders build a tar like residue on tooling. This requires frequent cleaning, higher tooling costs, and lowers foundry productivity. See Richardson U.S. Pat. No. 3,879,339.

It is also known to use additives to improve the core removal characteristics of phenolic binders. For example, Ohashi et al, U.S. Pat. No. 4,600,733, teaches that a "disintegration assistant" composed mainly of calcium hydroxide, calcium carbonate, barium hydroxide and/or barium carbonate will promote heat deterioration of condensation resins such as phenolic shell resins. Another example is described in Japanese Abstract J.P. 60,064,744, which discloses that metal bromides promote the collapsibility phenolic shell resins. S.U. Abstract 1,316,741 discloses the use of a water glass binder in mixture with iron oxide, sulfur, and silica based refractory filler that has improved knockout. The iron oxide is added to breakdown the binder which improves the knockout capability of the mixture.

SUMMARY OF THE INVENTION

This invention relates to foundry binder compositions comprising as a mixture:

(a) an organic foundry binder having at least one component; and (b) an effective amount of a divalent sulfur compound where said divalent sulfur compound is present in at least one component of the binder.

An effective amount of divalent sulfur compound is an amount sufficient to facilitate removal of a foundry shape from a metal casting, where the foundry shape is made from the organic binder containing the divalent sulfur compound.

The invention also relates to foundry binder systems where (a) and (b) are separate components, and foundry mixes that contain a divalent sulfur compound in the foundry aggregate. The invention also relates to a method of preparing a foundry shape, the shapes prepared, a method of making a metal casting, and metal castings prepared by this process.

The presence of sulfur in the binder composition and/or the aggregate facilitates the separation of the foundry shapes (cores and molds) from the metal part made by pouring molten metal into the foundry assembly. The effect of the sulfur in the foundry mix is particularly noteworthy when making aluminum parts with a casting assembly having internal cores. The time needed to remove the internal core from the metal part is significantly reduced which reduces cost and increased productivity.

These sulfur-containing organic binder compositions and/or foundry mixes are preferred for the cold-box process using phenolic urethane binders. Their advantages are most apparent when used to make internal cores that will be used in a casting assembly to cast aluminum parts.

BEST MODE AND OTHER EMBODIMENTS OF THE INVENTION

This invention can be used in any process, which utilizes an organic binder for making foundry shapes. For purposes of describing this invention, a foundry shape is any shape made from a foundry aggregate and organic binder that is used in a molding assembly for casting metal parts. A casting assembly is an arrangement of foundry shapes in a pattern such that a metal casting will be produced when molten metal is poured into the casting assembly and allowed to cool. An internal core is a core that is imbedded in the casting assembly. A foundry mix is a mixture of a foundry binder, and aggregate, and possibly a curing catalyst.

Foundry shapes can be prepared according to this invention by: (a) a cold-box or no-bake process which involves curing the foundry shape with a catalyst; and (b) heat cured processes such as the hot-box or warm-box processes, or the shell process which involves curing a foundry shape prepared with a novolak resin, a foundry aggregate, and hexamethylene diamine.

Any no-bake or cold-box organic binder, which will sufficiently hold the foundry mix together in the shape of a foundry shape such as a core or mold and polymerize in the presence of a curing catalyst, will work. Examples of some of the better-known organic binders include phenolic urethanes; aqueous alkaline phenolic resole resins; acrylic/epoxy resins; furan resins; and phenolic shell resins based on novolak resins. These binders are well known in the art and many of them have more than one component. See for instance U.S. Pat. Nos. 3,485,797 and 3,409,579 which relate to phenolic urethane binders cured with an amine catalyst; U.S. Pat. No. 4,526,219 which relates to epoxy-acrylic resins cured with sulfur dioxide and an oxidizing agent; U.S. Pat. No. 4,985,489 which relates to alkaline phenolic resole resins cured with carbon dioxide; U.S. Pat. No. 4,750,716 which relates to alkaline phenolic resole resins cured with methyl esters, all which are hereby incorporated by reference. Particularly preferred are phenolic urethane binders known as ISOCURE® cold-box and no-bake binders sold by Ashland Chemical Company.

Any sulfur compound where the sulfur atom is chemically bonded by two covalent bonds can be used as the sulfur compound. Typically used, as the divalent sulfur compound, is elemental sulfur. However, other divalent sulfur compounds can be used to augment core removal. For example, vulcanization accelerators such as sulfides; disulfides; sulfonamides; thiocarbamates; thiurams; tetrasulfides; xanthates; thiadiazines; thioureas; dithiocarbamates and benzothiazolethiolates of zinc, lead, and other heavy metals; and the like can be used separately, or in combination, with elemental sulfur.

The action of sulfur to promote removal of organically bound cores can be enhanced with catalysts. For instance, nucleophilic, electrophilic, and free radical catalysts are know to cleave S-S bonds and create polysulfides that are more reactive than cyclooctasulfur. "Reactions of Sulfur with Organic Compounds", Voronkov, M. G. et. al., Consultants Bureau of New York, a Division of Plenum Publishing New York, N.Y. (1987, pages 40–45, QD 412.S1R37 ISBN 0-303-10978-6). The action of sulfur can also be enhanced with phosphines, organomagnesium compounds, group IVA organometallic compounds, amines, sulfides, polysulfides, mineral and organic protic acids, Lewis acids such as boron and aluminum compounds, copper, zinc, platinum, activated charcoal, zinc sulfide, fluorides, metal oxides. Free radical generators such as peroxides, persulfates, azo compounds, and the like could also augment the action of sulfur.

The sulfur is added to the foundry aggregate and/or one or more of the components of the organic binder, where the component may be reactive or non reactive. As was mentioned before, one of the preferred organic binders is a phenolic urethane binder cured by an amine catalyst. This binder comprises a phenolic resin component or and organic polyisocyanate component, both of which are reactive components. The divalent sulfur compound can be added to either of these components.

The divalent sulfur compound can also be dissolved or dispersed in a liquid or solid medium before it is added to the foundry aggregate or the organic binder. Examples of liquid media that can be used to dissolve the divalent sulfur compound are solvents, e.g. carbon disulfide, petroleum distillate, or a resin such as a phenolic resin.

The divalent sulfur compound can also be dispersed in a dry medium such as a foundry additive mixture as disclosed in U.S. Pat. No. 4,735,973 and the like. Although a dispersant may be used in some situations to improve the dispersability of the divalent sulfur compound, it is not required to practice this invention. The sulfur is preferably dispersed in the binder in an amount of from 10 to 100 parts based on the weight of the binder.

The amount of sulfur needed to facilitate core removal and/or shakeout is from 1 to 200 weight percent based on the weight of the organic binder, preferably from 10 to 100 weight percent; or from 0.1 to 2.0 weight percent based on the weight of the foundry aggregate, preferably from 0.3 to 1.0 weight percent.

As was mentioned previously, curing the foundry shape preferably takes place by the cold-box process. The cold-box process involves blowing or ramming the foundry mix into a pattern where it is shaped, and then curing the foundry shape with a vaporous or gaseous catalyst. Various vapor or vapor/gas mixtures or gases such as tertiary amines, carbon dioxide, methyl formate, and sulfur dioxide can be used depending on the chemical binder chosen. Those skilled in the art will know which gaseous curing agent is appropriate for the binder used. For instance, epoxy-acrylic binders cured with sulfur dioxide in the presence of an oxidizing agent are described in U.S. Pat. No. 4,526,219, which is hereby incorporated into this disclosure by reference. Alkaline phenolic resole resins cured with carbon dioxide are described in U.S. Pat. No. 4,985,489, which is hereby incorporated into this disclosure by reference. Alkaline phenolic resole resins cured with methyl esters are described in U.S. Pat. No. 4,468,359, which is hereby incorporated into this disclosure by reference.

As was mentioned previously, the preferred cold-box binder is an ISOCURE® phenolic urethane binder cured by passing a tertiary amine gas, such a triethylamine, through the molded foundry shape in the manner as described in U.S. Pat. Nos. 3,409,579 and 3,485,497, which are hereby incorporated into this disclosure by reference. These binders are based on a two-part system, one part being a phenolic resin component and the other part being a polyisocyanate component. Typical gassing times are from 0.5 to 3.0 seconds, preferably from 0.5 to 2.0 seconds. Purge times are from 1.0 to 60 seconds, preferably from 1.0 to 10 seconds.

The phenolic resole resin used in the phenolic resin component is preferably prepared by reacting an excess of an aldehyde with a phenol in the presence of either an alkaline catalyst or a metal catalyst. The preferred phenolic resins used in the subject binder compositions are well known in the art, and are specifically described in U.S. Pat. No. 3,485,797 which is hereby incorporated by reference. These resins, known as benzylic ether phenolic resole resins are the reaction products of an aldehyde with a phenol. They contain a preponderance of bridges joining the phenolic nuclei of the polymer, which are ortho-ortho benzylic ether bridges. They are prepared by reacting an aldehyde and a phenol in a mole ratio of aldehyde to phenol of at least 1:1 in the presence of a metal ion catalyst, preferably a divalent metal ion such as zinc, lead, manganese, copper, tin, magnesium, cobalt, calcium, and barium.

The phenols use to prepare the phenolic resole resins include any one or more of the phenols which have heretofore been employed in the formation of phenolic resins and which are not substituted at either the two ortho-positions or at one ortho-position and the para-position such as unsubstituted positions being necessary for the polymerization reaction. The aldehyde used to react with the phenol has the formula RCHO wherein R is a hydrogen or hydrocarbon radical of 1 to 8 carbon atoms. The most preferred aldehyde is formaldehyde.

Organic polyisocyanates used in the organic polyisocyanate component are liquid polyisocyanates having a functionality of two or more, preferably 2 to 5. They may be aliphatic, cycloaliphatic, aromatic, or a hybrid polyisocyanate. Mixtures of such polyisocyanates may be used. The polyisocyanates should have a viscosity of about 100 to about 1,000, preferably about 200 to about 600.

Solvents are typically used in the organic polyisocyanate component and/or phenolic resin component. If solvents are used in either, those skilled in the art will know how to select them. Typical organic solvents include aromatic solvents, esters, ethers, or possibly mixtures of these solvents. In general, the solvent concentration in the polyisocyanate and/or phenolic resin component is up to 80% by weight of the polyisocyanate or phenolic resin, typically in the range of 20% to 80%.

The phenolic resin and polyisocyanate are used in sufficient concentrations to cure in the presence of the volatile amine curing catalyst. In general the isocyanate ratio of the polyisocyanate to the hydroxyl of the phenolic resin component (NCO/OH ratio), is from 1.25:1.0 to 0.60:1.0, preferably about 0.9:1.0 to 1.1:1.0, and most preferably about 1.0:1:0.

Various types of aggregate and amounts of binder are used to prepare foundry mixes by methods well known in the art. The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chrornite sand, and the like.

The amount of binder needed is an amount that is effective in producing a foundry shape that can be handled or is self-supporting after curing. In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

Optional ingredients for the binder include release agents, benchlife extenders, and adhesion promoters to improve humidity resistance, e.g. silanes as described in U.S. Pat. No. 4,540,724 which is hereby incorporated by reference.

A description of the components used in the examples follows:

| | | |
|---|---|---|
| AROMATIC HYDROCARBON | = | aromatic solvent having a boiling point between about 175° C. and 200° C. |
| DISPERSANT | = | DISPERBYK 161, a product of BYK Chemie USA. |
| DRYING OIL | = | a polylinseed oil |
| ESTER SOLVENT | = | ester solvent having a boiling point of 200 to 225° C. |
| FATTY ACID | = | a tall oil having an acid no. of 170–180. |
| MDI | = | a polymethylene polyphenyl polyisocyanate having a functionality of 2.5 to 2.8. |
| PHENOLIC RESIN | = | benzylic ether phenolic resole resin having a GPC weight average molecular weight of from about 800 to 1200 prepared by reacting phenol and formaldehyde along the lines of the process described in U.S. Pat. No. 3,485,797. |
| S | = | elemental sulfur |

EXAMPLES

The examples will illustrate specific embodiments of the invention. These examples along with the written description will enable one skilled in the art to practice the invention. It is contemplated that many other embodiments of the invention will be operable besides these specifically disclosed.

The foundry binders are used to make foundry cores by the cold-box process using a tertiary amine catalyst (triethyl amine) to cure a phenolic urethane binder. All parts are by weight and all temperatures are in ° C. unless otherwise specified.

In Example 1, the foundry mix was prepared by first mixing elemental sulfur with Wedron 540 silica sand. Then the phenolic resin component was added and mixed, followed by the polyisocyanate component. In Examples 2–4, binder Parts I and II, were mixed with the sand, and then the elemental sulfur was added to this mixture. In Examples 5, the elemental sulfur was dispersed in the phenolic resin component of the binder. Then this dispersion and the polyisocyanate component of the binder were added to and mixed with the sand.

The amounts of the various components are specified in the tables, and are in weight percent based upon the weight of the binder (bob), or in weight percent based upon the sand mixture (bos).

The resulting foundry mixes were shaped by blowing the foundry mix into a pattern corebox to make internal test cores that were used in casting an aluminum part. The shaped mix in the corebox was contacted with triethyl amine (TEA) at 20 psi for 1 second, followed by a 6 second nitrogen purge at 40 psi., thereby forming AFS tensile strength test cores in the shape of a dog bones. The temperature of the constant temperature room (CT) was 25° C. and the relative humidity was 50%. Dog bones and shakeout cores were stored in the CT room prior to testing. Dog bones (at 24 Hrs.) were also wrapped in aluminum foil and baked in a forced air oven at 750° C. for 10 minutes and cooled to room temperature prior to testing.

The test cores produced were solid and shaped like a trapezoid and had a height of 1". There are two 5" converging sides to the trapezoid. The converging sides of the trapezoid create two end "faces", one having a length of 1.50", and the other having a length of 3.75". The trapezoid test cores had three tubular stems, one on the 1.5" face and two on the 3.75" face. The stems in the trapezoid test cores were designed so that holes result in the aluminum casting made from the trapezoid test core. The hole-generating stems were 0.75" in diameter.

The test cores were used as internal cores to make an aluminum casting. A test core was placed in the bottom half of a sand mold designed for placement of the test core. Then the top half of the mold, which contained a sprue through which metal could be poured, was inserted on top of the bottom half.

Molten Aluminum 319 having a temperature of 730° C. was poured into the casting assembly and then allowed to cool. The resulting aluminum casting was a hollow trapezoid having a thickness of 0.25". There is one hole at the center of the 1.5" end face of the trapezoid and two holes on the 3.75" end face that are about 1.5" apart and each about 0.75" from the end. The top of the trapezoid casting had a block of metal protruding from it that is used to attach the aluminum casting to the Herschal hammer during the shake-out test.

The shakeout tests where conducted at room temperature (cold) by attaching the aluminum casting to a 40 psi mechanical Herschal hammer to the protrusion on the trapezoid test casting. The Herschal hammer applied pressure on the casting at 15 second intervals until the internal core was removed from the aluminum casting through the holes in the test core. The amount of sand exiting the casting from the hole on the 1.5 inch face of the trapezoid casting was measured every 15 seconds.

EXAMPLES 1–4

SULFUR IS ADDED TO AGGREGATE

Binder formulation A, which is shown in Table I, was used in Examples 1–4. In these examples, the elemental sulfur was added to the aggregate.

TABLE I

BINDER FORMULATION CONTROL

| PART I PHENOLIC RESIN COMPONENT (pbw) | | PART II POLYISOCYANATE COMPONENT (pbw) | |
|---|---|---|---|
| RESIN | 53.0 | MDI | 71.0 |
| ESTER SOLVENT | 16.7 | AROMATIC SOLVENT | 25.0 |
| AROMATIC SOLVENT | 29.3 | DRYING OIL | 4.0 |
| FATTY ACID | 1.0 | | |

TABLE II

TENSILE STRENGTHS (PSI) OF TEST CORES PREPARED WITH AND WITHOUT SULFUR

| | Binder Formulation (bos) | | | Average Tensile Strength (psi) | | | |
|---|---|---|---|---|---|---|---|
| Example | Part I | Part II | S (bos) | 30 sec. | 1 Hr. | 24 Hr. | 750° C. (10 mins) |
| CONTROL | 0.66 | 0.54 | 0.0 | 116 | 146 | 98 | 58 |
| 1 | 0.66 | 0.54 | 0.6 | 109 | 111 | 92 | 2 |

TABLE III

COLD SHAKEOUT COMPARISON WITH AND WITHOUT SULFUR

| Shakeout Time (seconds) | Weight % Core Shakeout | |
|---|---|---|
| Binder | A | 1 |
| S (wt % bos) | 0.0 | 0.6 |
| 15 sec. | 44 | 100 |
| 30 sec. | 75 | |
| 45 sec. | 92 | |
| 60 sec. | 99 | |
| 75 sec. | 100 | |

Table III shows the effect of adding sulfur to the binder formulation. All of the sand of the internal core shook out in 15 seconds for the internal test core made with the binder containing sulfur (Example 1). On the other hand, it took the sand 75 seconds to shake out for the internal test core made with the binder which did not contain sulfur (CONTROL).

Binder formulation CONTROL again was used with varying amounts of elemental sulfur in Examples 2–4. The amount of sulfur used in the formulations is shown in Table IV. The same amount of binder (bos) was used as shown in Table II. Shakeout tests were again run. The shakeout results are shown in Table V.

TABLE IV

COLD SHAKEOUT COMPARISON WITH AND WITHOUT SULFUR

| Shakeout Time (seconds) | Weight % Core Shakeout | | | |
|---|---|---|---|---|
| Example | CONTROL | 2 | 3 | 4 |
| S (wt %) | 0.0 | 0.1 | 1.0 | 2.0 |
| 15 sec. | 25 | 56 | 100 | 34 |
| 30 sec. | 52 | 91 | | 93 |
| 45 sec. | 57 | 100 | | 96 |
| 60 sec. | 76 | | | 100 |
| 75 sec. | 84 | | | |
| 90 sec. | 89 | | | |
| 105 sec. | 95 | | | |
| 120 sec. | 96 | | | |

Table IV confirms the effect of adding sulfur to the binder formulation at different amounts. Internal test cores made with the binders containing the sulfur shook out completely in 60 seconds or less. The data also indicates there is an optimum amount of sulfur, about 1.0 part by weight bos to obtain the best shake out properties.

Example 5 shows a binder formulation where the sulfur is added to the binder rather than the aggregate. In this example, a sulfur dispersion was first prepared by mixing elemental sulfur, the resin, and ester solvent in the amount shown in Table V. The resulting dispersion was then mixed with the phenolic resin components of the binder in the amount indicated in Table VI.

TABLE V

| DISPERSED SULFUR | |
|---|---|
| COMPONENT | PBW |
| RESIN | 160.0 |
| ESTER SOLVENT | 40.0 |
| DISPERSANT | 0.5 |
| SULFUR | 100.0 |

Table VI shows the binder formulation that was used in Example 5. The amount of Part I used in Example 5 is 133 pbw, greater by about 33% pbw than in the previous examples, but the ratio of hydroxyl groups in the phenolic resin component to isocyanato groups in the polyisocyanate component is the same as in the previous examples. The increased weight is attributable to the addition of the elemental sulfur in the Part I.

TABLE VI

| BINDER FORMULATION CONTAINING DISPERSED SULFUR | | | |
|---|---|---|---|
| PART 1 PHENOLIC RESIN COMPONENT (pbw) | | PART II POLYISOCYANATE COMPONENT (pbw) | |
| DISPERSED SULFUR | 100.0 | MDI | 70.0 |
| ESTER SOLVENT | 3.8 | AROMATIC SOLVENT | 25.0 |
| AROMATIC SOLVENT | 28.3 | DRYING OIL | 4.0 |
| FATTY ACID | 1.0 | | |

Table VIII shows shake out test data for the binder formulation set forth in Table VI.

TABLE VII

| SHAKEOUT RESULTS USING BINDER FORMULATION CONTAINING DISPERSED SULFUR | | |
|---|---|---|
| Shakeout Time (seconds) | Weight % Core Shakeout | |
| Example | CONTROL | 5 |
| S (wt %) | 0.0 | 0.3 |
| 15 sec. | 24 | 79 |
| 30 sec. | 40 | 91 |
| 45 sec. | 45 | 95 |
| 60 sec. | 53 | 100 |
| 75 sec. | 66 | |
| 90 sec. | 80 | |
| 105 sec. | 88 | |
| 120 sec. | 91 | |

Example 5 shows that a binder formulation, where the sulfur is added to the binder rather than the aggregate, also reduces the time for core removal. The test indicates that shakeout for the internal core made with the binder containing sulfur took less than one half the time to shakeout from the aluminum casting.

I claim:

1. A foundry binder composition comprising as a mixture:

(a) an organic foundry binder; and (b) an effective amount of a divalent sulfur compound in the binder to facilitate removal of foundry shape from metal casting.

2. The foundry binder composition of claim 1 wherein the divalent sulfur compound is elemental sulfur.

3. The foundry binder composition of claim 2 wherein the organic binder is selected from the group consisting of phenolic-urethane binders, phenolic shell binders, aqueous alkaline phenolic resole binders, acrylic/epoxy binders, and furan binders.

4. The foundry binder composition of claim 3 wherein the organic binder is a cold-box binder.

5. The foundry binder composition of claim 4 wherein in the cold-box binder is a phenolic urethane binder.

6. The foundry binder composition of claim 5 wherein the divalent sulfur compound is dispersed in a solvent or a resin before adding said divalent sulfur compound to the organic binder.

7. A foundry mix comprising:

(a) a major amount of a foundry aggregate;

(b) an effective binding amount of an organic foundry binder; and (c) an effective amount of a divalent sulfur compound to facilitate removal of foundry shape from metal casting.

8. The foundry mix of claim 7 wherein the divalent sulfur compound is elemental sulfur.

9. The foundry mix of claim 8 wherein the organic binder of the foundry mix is selected from the group consisting of phenolic-urethane binders, phenolic shell binders, aqueous alkaline phenolic resole binders, acrylic epoxy binders, and furan binders.

10. The foundry mix of claim 9 where the organic binder is a cold-box binder.

11. The foundry mix of claim 10 wherein the cold-box binder is a phenolic urethane binder.

12. The foundry mix of claim 11 wherein the divalent sulfur compound is dispersed in a liquid dispersant before mixing said divalent sulfur compound with (a) or (b).

13. A cold-box process for preparing foundry shapes which comprises:

(A) introducing a foundry mix of claim 7, 8, 9, 10, 11, or 12 into a pattern to prepare an uncured foundry shape;

(B) contacting said uncured foundry shape prepared by (A) with a vaporous curing catalyst;

(C) allowing said foundry shape resulting from (B) to cure until said shape can be handled without breaking; and (D) removing said foundry shape from the pattern.

14. The process of claim 13 wherein the foundry shape is an internal core.

15. The process of claim 14 wherein the binder is a phenolic urethane binder.

16. A foundry shape prepared in accordance with claim 15.

17. A process for casting a metal part which comprises:

(A) inserting a foundry shape of claim 16 into a casting assembly;

(B) pouring metal, while in the liquid state, into said casting assembly;

(C) allowing said metal to cool and solidify; and (D) then separating the cast metal part from the casting assembly.

18. The process of claim 17 wherein the metal is aluminum.

19. The process of claim 18 wherein the foundry shape is an internal core.

20. A metal part prepared in accordance with claim 19.

21. A foundry binder system comprising:

(a) an organic foundry binder; and (b) a divalent sulfur compound, where (a) and (b) are separate components.

22. The foundry binder system of claim 21 wherein the divalent sulfur compound is elemental sulfur.

23. The foundry binder system of claim 22 wherein the organic binder is selected from the group consisting of phenolic-urethane binders, phenolic shell binders, aqueous alkaline phenolic resole binders, acrylic/epoxy binders, and furan binders.

24. The foundry binder system of claim 23 wherein the organic binder is a cold-box binder.

25. The foundry binder system of claim 24 wherein in the cold-box binder is a phenolic urethane binder.

26. The foundry binder system of claim 25 wherein the divalent sulfur compound is dispersed in a solvent or resin before adding said divalent sulfur compound to the organic binder.

* * * * *